United States Patent [19]

Naruse

[11] Patent Number: 4,519,287

[45] Date of Patent: May 28, 1985

[54] OUTPUT JACK FOR ELECTRIC GUITAR

[75] Inventor: Fumio Naruse, Hamamatsu, Japan

[73] Assignee: Nippon Gakki Seizo Kabushiki Kaisha, Hamamatsu, Japan

[21] Appl. No.: 573,518

[22] Filed: Jan. 25, 1984

[30] Foreign Application Priority Data

Feb. 10, 1983 [JP] Japan ..... 58-18470[U]

[51] Int. Cl.[3] ..... G10H 3/00

[52] U.S. Cl. ..... 84/1.16; 339/205; 200/51 R

[58] Field of Search ..... 339/205; 84/1.16; 200/51 R, 51.02, 51.09; 381/123

[56] References Cited

U.S. PATENT DOCUMENTS 4,082,409 4/1978 Bailey et al. ..... 339/205

*Primary Examiner*—Forester W. Isen

*Attorney, Agent, or Firm*—Spensley, Horn, Jubas & Lubitz

[57] ABSTRACT

An output jack for an electric acoustic guitar is installed at a guitar body and is adapted to receive a first plug connected to one end of a first cable which couples an output tone signal of the guitar to an external power amplifier. The jack further comprises a receptacle portion inside the guitar body for receiving a second plug connected to one end of a second cable, the other end of which is coupled to a pickup device. The output tone signal of the guitar is transmitted to the external power amplifier via the second cable, the second plug, the jack, the first plug, and the first cable in this order. The jack further comprises an electromagnetic shielding member for shielding the second plug from an electromagnetic induction against the second plug.

2 Claims, 5 Drawing Figures

OUTPUT JACK FOR ELECTRIC GUITAR

BACKGROUND OF THE INVENTION

1. Field of the Invention

This invention relates to an output jack for an electric guitar such as an electric acoustic guitar, and more particularly, to an output jack installed at a body of the electric guitar and adapted to receive a plug connected to one end of a cable which couples an output of the electric guitar to an external electrical circuit device.

2. Description of the Prior Art

An electrical signal obtained by a pickup device for picking-up vibrations of guitar strings is transmitted to an external amplifier and a loudspeaker via an output jack installed at a guitar body. The jack is electrically connected to the pickup device and the external amplifier with respective lead wires.

FIG. 1 shows a conventional jack installation structure in an electric acoustic guitar. In FIG. 1, a body 1 comprises a sound board 2, a back board 3, and a side board 4, which construct a sound box, and has a sound hole 8 at the central portion of the sound board 2. To an outer surface of the sound board 2 is secured a tail-piece 5 by a bonding agent. A bridge 6 for being saddled by six strings 10, and six pins 7 for fixing ends of the strings 10 are disposed on the tail-piece 5. To a head side of the body 1 is securely fixed a neck 9, and the strings 10 are tigntened between the pins 7 and tuning keys disposed at a head portion of the neck (not shown). Under the bridge 6 or at an appropriate portion of the tail-piece 5 is mounted a pickup device having a piezo-electric element and a pair of terminals attached opposite surfaces of the element (not shown). Musical sound of electrical signal which is converted from mechanical vibrations of the strings 10 is transmitted to an amplifier device disposed on a surface of the side board 4 in the sound box of the body 1. An amplified musical sound signal from the amplifier device 12 is transmitted, via lead wires 15, to a jack 14 installed at a tail portion 1A of the body 1. A block 13 is adapted to reinforce the tail portion 1A. Accordingly, the amplified musical sound signal is transmitted to an external electric circuit device and a loudspeaker, via the lead wires 15, the jack 14, a plug 16 to be connected to the jack 14, and lead wires for electrically coupling the plug 16 to the external device. An opening portion of the jack 14 has a hook portion which functions as an end pin for receiving a strap 17.

The prior art structure as described above, however, has following drawbacks. As the connections between the lead wires 15 and terminals 19 of the jack 14 is made by using solder, it is easily possible that open-circuiting at the connections and short-circuiting between the terminals 19 will be developed, and a solder bonding work is troublesome. Furthermore, it is necessary to utilize an electromagnetic shielding member for preventing electromagnetic induction at the connection portion between the lead wires 15 and the terminals 19 of the jack 14. A nut 20 for fixing the jack 14 in FIG. 1, accordingly, has a special shape which shields the terminals 19. However, the nut 20 must be fastened in the sound box of the body 1, so that the fastening work is also troublesome, and it is difficult to fasten the nut 20 securely, and a special instrument for fastening the nut 20 is required.

SUMMARY OF THE INVENTION

It is accordingly an object of this invention to provide an output jack for an electric guitar overcoming the above enumerated drawbacks.

Another object of this invention is to provide an output jack in which connections of lead wires to the jack are detachable so as to facilitate such connection work.

A further object of this invention is to provide an output jack in which connections of lead wires to the jack are made by means of reliable plug-jack connection.

Yet another object of this invention is to provide an output jack in which terminals disposed in the jack are electromagnetically shielded by a casing of the jack, so that a noise development due to electromagnetic induction at the terminals is prevented.

A still further object of this invention is to provide an output jack which can be easily attached with and detached from the guitar body.

In brief, an output jack according to this invention comprises:

a cylindrical body attached to a guitar body and having a first opening into which a first plug connected to a pickup device is inserted, and a second opening into which a second plug connected to an external electric circuit device is inserted;

first terminal means disposed at the first opening and holding the first plug and being in electrical contact with terminals of the first plug when the first plug is inserted into the first opening;

second terminal means disposed at the second opening and holding the second plug and being in electrical contact with terminals of the second plug when the second plug is inserted into the second opening;

the first and second terminal means being electrically coupled to each other so as to transmit an electrical signal from the pickup device to the external electric circuit device; and a cylindrical electromagnetic shielding member elongating from the first opening and/or second opening in an axial direction of the cylindrical body.

DETAILED DESCRIPTION OF THE PREFERRED EMBODIMENT

Figure 2:
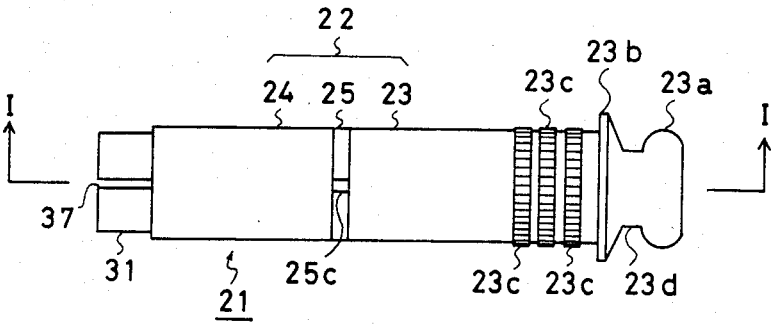
FIG. 2 is a plan view of the jack according to the invention.
Figure 3:
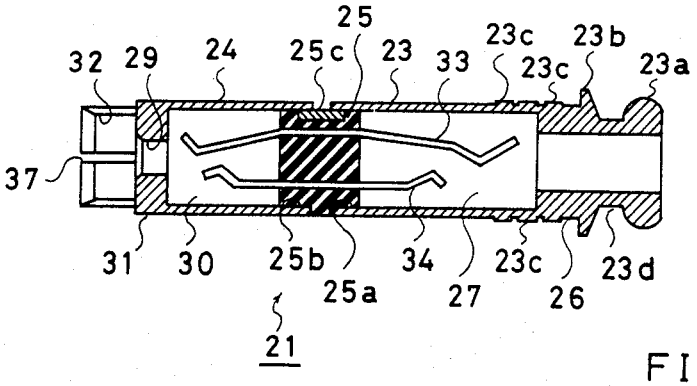
FIG. 3 is a sectional view taken along line I—I of FIG. 2.

FIGS. 2 and 3 are respective plan and sectional views of an output jack for a guitar of this invention. In these Figs., a jack 21 comprises a cylindrical body 22 which is constructed with cylindrical metal members 23 and 24 of brass and a columnar plastic member 25 of styrene resin. The members 23 and 24 are securely fixed to respective step portions **25*a* and 25*b* of the member 25 by means of screw coupling or bonding agent. In a ditch formed at a periphery portion of the member 25**, a metal member 25*c* of phosphor bronze is struck so as to make electrical connection between metal members 23 and 24.

Figure 1:
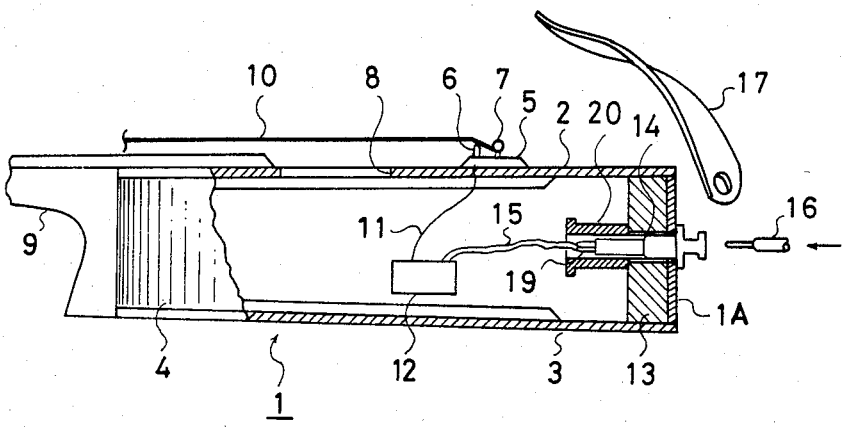
FIG. 1 PRIOR ART
FIG. 1 is a partially cutaway side elevational view of the guitar with a prior art jack installation structure.

A sleeve 26 for receiving a large concentric plug is formed at the opening end of the member 23, and inside the sleeve 26 is formed a hole 27 in which end portions of springs 33 and 34 functioning as terminals are disposed. At the periphery of the sleeve 26, two ridges 23*a* and 23*b* are formed, and at a valley 23*d* between the ridges 23*a* and 23*b* is hooked a strap 17 as shown in FIG. 1. Reference numerals 23*c* designate small ridges formed at the periphery of the member 23, the surfaces of which have knurling stripes in the direction parallel to a longitudinal axis of the jack 21. The jack 21 is firmly struck into a hole formed at the tail portion 1A of the guitar body as shown in FIG. 1, and the stripes functions to prevent the jack 21 from being loosen or unfastened. It should be noted here that the jack 21 may be installed by means of nut technique as shown in FIG. 1 if the practical construction is not complex.

At another end of the jack 21, a sleeve 31 having openings 29 and 32 at the center portion is formed extending from the member 24. A knob of a small concentric plug is received in the opening 32, and a sleeve of the plug is inserted into the opening 29. Inside the sleeve 31, a hole 30 is formed, where the other end portions of the springs 33 and 34 are disposed. The springs 33 and 34 are caught by the member 25 at their center portions, by means of plastic molding operation, and are electrically insulated with each other and with the metal members 23 and 24. To enhance the security of short-circuiting between the spring 33 or 34 and the members 23 and 24, the springs 33 and 34 may be jointly covered with vinyl tube members. By using this tube members, secular change in holding forces of the springs 33 and 34 against the plugs inserted is reduced due to an additional holding force of the tube member, incidentally.

Figure 4:
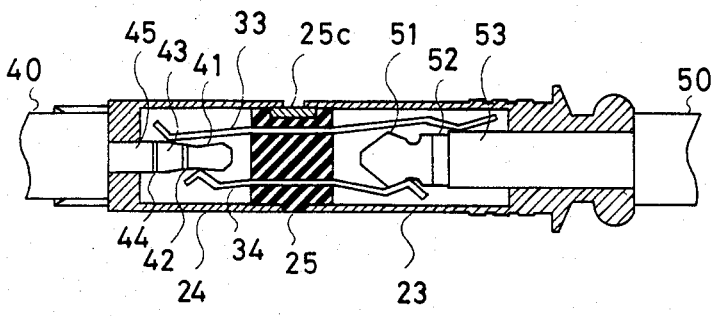
FIG. 4 is a sectional view of the jack of FIG. 2 showing a condition where plugs are inserted into the jack.

FIG. 4 shows the jack of FIG. 2 with plugs received. In FIG. 4, a chip 41 and a ring 43 of the small concentric plug 40 are touched with and held by one ends of the springs 34 and 33, respectively. A sleeve 45 of the plug 40 is in contact with the sleeve 31. The chip 41, the ring 43, and the sleeve 45 are electrically insulated by insulating collars 42 and 44. On the other hand, a chip 51 and a sleeve 53 of the large concentric plug 50 are touched with and held by the other ends of springs 34 and 33, respectively. The sleeve 53 of the plug 50 is further in contact with the sleeve 26 of the jack 21. An insulating collar 52 insulates the chip 51 with the sleeve 53. It should be noted here that since the plug 40 is inserted into the opening 32 and is electromagnetically shielded by the sleeve 31, the electromagnetic induction to the plug 40 is prevented. In FIGS. 2 and 3, reference numeral 35 designates four cuts formed at the periphery of the sleeve 31 at same distance from each other so that the sleeve 31 securely holds the plug 40 with its restoring force. It should be noted here that the shape of the sleeve 31 may be changed in accordance with the shape of the plug 40. It should be also noted here that although the jack 21 has the electromagnetic shielding member only at the one end thereof, such electromagnetic shielding member may be formed against both ends of the jack.

Figure 5:
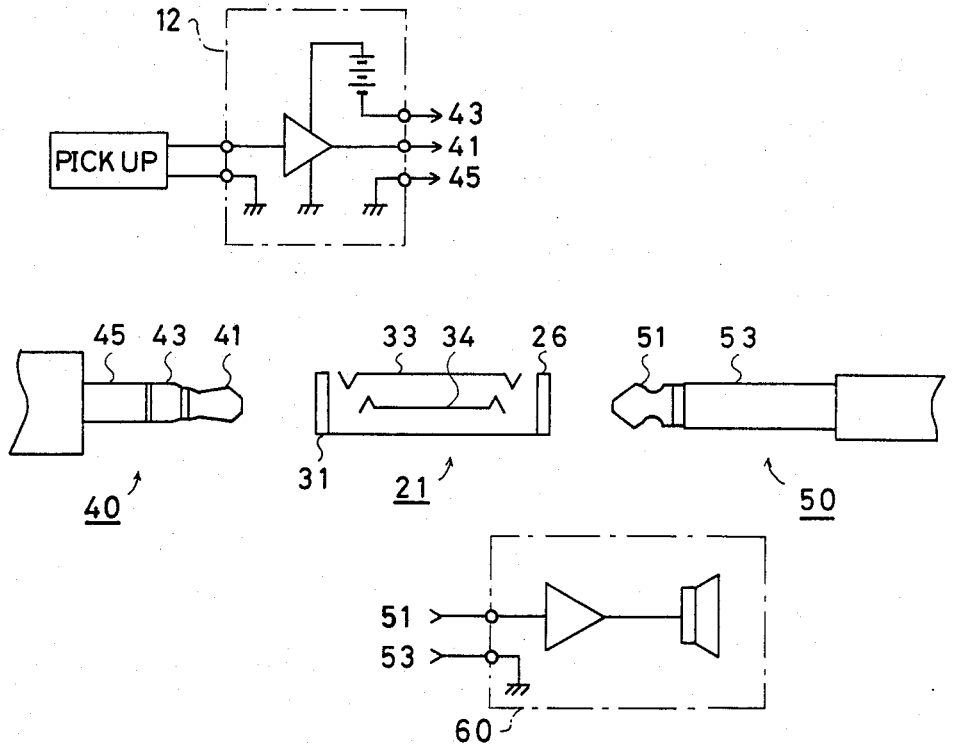
FIG. 5 is a shematic circuit diagram showing an electrical connection of the jack.

FIG. 5 shows a schematic circuit diagram explaining an electrical connection of the jack. In FIG. 5, to the plug 40 is connected terminals of the amplifier device 12, while the external device 60, for example, a power amplifier device and loudspeaker, is connected to the plug 50. In detail, the output signal (hot line) terminal and the ground terminal of the amplifier device 12 are coupled to the chip 41 and the sleeve 45 of the plug, respectively, and the negative terminal of the power supply (battery) of the amplifier device 12 is coupled to the ring 43 of the plug 40. As the plug 40 is normally received by the jack 21, to the springs 34 and 33 and the sleeve 26 are coupled the output signal of the amplifier device 12, the ground potential signal, and the negative terminal of the power supply of the amplifier device 12. If the plug 50 is not inserted in the jack 21, the negative terminal of the battery of the amplifier device 12 is in a floating condition, and accordingly the amplifier device 12 is not operable and the consumption of the battery can be saved. While the plug 50 is inserted into the jack 21 when a performance of the guitar is done. On this condition, the output signal and the ground potential derived from the spring 34 and 33 are transmitted to input signal and ground terminals of the external device 60 via the chip 51 and the sleeve 53 of the plug 50, respectively, and the negative terminal of the battery is grounded in the amplifier device 12 via the sleeve 53, 26, 31, and 45. And accordingly, the musical tone signal from the pickup device is reproduced by the external device 60.

What is claimed is:

1. A combined output jack and amplifier switching assembly in an electric guitar of the type having an amplifier and a battery for powering the amplifier contained within the body of the guitar, said assembly comprising:

a jack mounted in a wall of said guitar body, said jack having separate first and second plug receiving openings in respective ends thereof, said jack having an outer shield and two resilient contact electrodes interior thereof, the first ends of said contact electrodes being positioned respectively to provide electrical contact to the ring and tip terminals of a three wire plug inserted into said first opening, the other ends of said contact electrodes being positioned for electrical contact respectively with the tip and shaft of a two wire plug inserted into the second of said openings, a three wire plug having a shaft, a ring and a tip, said plug having its tip wired to the output of said amplifier, having its ring wired to one terminal of said battery, the other terminal of said battery being connected to said amplifier, and the shaft of said plug being wired to amplifier ground, said plug being insertable into said first opening interiorly of said guitar, whereby when said two wire plug is inserted into said second opening, an electrical circuit will be completed from said battery to said amplifier via the ring terminal of said three wire plug, one of said resilient contact electrodes, the shaft of said two wire plug, the outer shield of said jack and the shaft of said three wire plug back to amplifier ground, so that removal of said second plug will disconnect the battery from said amplifier.

2. A coupling jack and switching assembly comprising:

a coupling jack adapted to receive two plugs, said jack having an outer shield and two internal contact members, a three-terminal plug insertable into said coupling jack with its three terminals in respective electrical contact with said shield and said two internal contact members, an amplifier and a battery, one end of said battery being connected to one power terminal of said amplifier, the other end of said battery being connected to one terminal of said three-terminal plug, an output of said amplifier being connected to the second terminal of said three-terminal plug, and the other power terminal of said amplifier being connected to the third terminal of said plug, and a two-terminal plug insertable into said coupling jack, and configured so that when said three-terminal plug and said two-terminal plug are both inserted, one terminal of said two-terminal plug will be in contact with that internal contact member which also connects to said second terminal, and the other terminal of said two-terminal plug will complete a circuit between the second internal contact member and said outer shield, whereby insertion of said two-terminal plug will both provide electrical communication via said one terminal of said two-terminal plug for the output of said amplifier and will effectuate electrical connection of said battery other end to said other power terminal of said amplifier.

* * * * *